US006490907B2

(12) United States Patent
Dobbins et al.

(10) Patent No.: US 6,490,907 B2
(45) Date of Patent: Dec. 10, 2002

(54) SYSTEM FOR ANCHORING FRAMES TO A PLATFORM

(75) Inventors: Jeff Dobbins, Grand Island, NE (US); Roger Harmon, Winchester, KY (US); Melvin Soyk, Grand Island, NE (US)

(73) Assignee: Delaware Capital Formation, Inc.

( * ) Notice: Subject to any disclaimer, the term of this patent is extended or adjusted under 35 U.S.C. 154(b) by 0 days.

(21) Appl. No.: 09/885,830

(22) Filed: Jun. 20, 2001

(65) Prior Publication Data

US 2001/0035041 A1 Nov. 1, 2001

Related U.S. Application Data

(63) Continuation of application No. 09/306,937, filed on May 7, 1999, now Pat. No. 6,272,898.

(51) Int. Cl.[7] ..... B21J 13/08
(52) U.S. Cl. ..... 72/457; 72/705
(58) Field of Search ..... 72/457, 705, 293, 72/295, 700, 311, 460

(56) References Cited

U.S. PATENT DOCUMENTS

| | | | | |
|---|---|---|---|---|
| 2,013,785 A | | 9/1935 | Merrill | |
| 2,750,983 A | | 6/1956 | Rogers | |
| 3,241,352 A | | 3/1966 | Lincourt | |
| 4,107,974 A | * | 8/1978 | Kuhn | 72/705 |
| 4,238,951 A | | 12/1980 | Grainger et al. | |
| 4,344,314 A | | 8/1982 | Aldrich et al. | |
| 4,516,423 A | | 5/1985 | Reich | |
| 4,520,649 A | | 6/1985 | Barton, Sr. | |
| 4,643,014 A | | 2/1987 | Eppinger | |
| 4,761,984 A | | 8/1988 | Fuscaldo, Jr. | |
| 4,815,719 A | | 3/1989 | Peters et al. | |
| 4,997,283 A | | 3/1991 | Danielson et al. | |
| 5,014,538 A | * | 5/1991 | Eltvik | 72/705 |
| 5,207,002 A | | 5/1993 | Humblet | |
| 5,251,013 A | | 10/1993 | Danielson et al. | |
| 5,335,277 A | | 8/1994 | Harvey et al. | |
| 5,351,986 A | * | 10/1994 | Hedenberg et al. | 280/712 |
| 5,415,023 A | | 5/1995 | Hinson | |
| 5,801,834 A | | 9/1998 | Danielson et al. | |
| 6,279,950 B1 | * | 8/2001 | Armstrong | 280/754 |

* cited by examiner

*Primary Examiner*—Ed Tolan
(74) *Attorney, Agent, or Firm*—Hovey Williams LLP

(57) ABSTRACT

A system (20) for anchoring a vehicle frame (22) to a platform (24) utilizes a variety of securement components (34, 36, 38, 40, 42, 44, 46, 48) to secure the vehicle frame (22) from movement at desired locations while the vehicle frame (22) is being aligned with pulling forces applied by pulling towers (26). The securement components (34, 36, 38, 40, 42, 44, 46, 48) are held on cross beams (28, 30) which mount to anchoring stands (32), and the anchoring stands (32) are attached to the platform (24). The securement components include a rail vise (34), a C-channel clamp (36), a leaf spring shackle (38), L-clamps (40,41), a slide plate (42), a hole adapter (44), a tie-down ratchet assembly (46), and a turnbuckle assist (48). The rail vise has two guide channels (78, 80) which slidably receive guide pins (114) therein. The guide pins (114) extend from a front movable clamp leg (74). The leaf spring shackle (38) includes an L-shaped base plate (152) and a clamp member (154), which cooperate to clamp a mounting bracket (158) of a leaf spring (176) therebetween. The hold adapter (44) includes a reference hole insert (216) sized and configured to fit in a reference hole (226) of the vehicle frame (22) with slip clearance. The hole adapter (44) also includes an adapter ring (232) for larger reference holes (230). The tie-down ratchet assembly (46) includes a tie-down strap (244) and a ratchet mechanism (248) which is operative to incrementally tension the strap (244).

17 Claims, 12 Drawing Sheets

SYSTEM FOR ANCHORING FRAMES TO A PLATFORM

RELATED APPLICATION

This is a continuation of application Ser. No. 09/306,937 now U.S. Pat. No. 6,272,898 filed May 7, 1999.

FIELD OF THE INVENTION

This invention relates to systems for securing vehicles undergoing vehicle frame alignment and, more particularly, to securement components used to secure vehicles at desired locations for frame alignment.

BACKGROUND OF THE INVENTION

When a vehicle body has been damaged, the frame or chassis of the vehicle is frequently distorted. To correct the frame distortion, various locations of the vehicle frame are secured from movement and pulling force is applied to the vehicle frame in a desired direction at a desired location. To achieve alignment, multiple pulling forces can be applied at various locations on the vehicle frame until alignment is achieved as taught by U.S. Pat. Nos. 4,997,283, 5,251,013, and 5,801,834 to Danielson et al. which are hereby fully incorporated herein by reference.

While pulling forces are being applied, it is important that the selected locations are securely held by the securement components to substantially prevent movement. Conventional securement components are generally adequate to secure vehicle frames after they are attached, but some of these securement components are difficult to attach to vehicle frames and lack the ability to attach to vehicle frames in a sufficient variety of desired locations.

Thus, reduction in the labor and time required to attach securement components is desirable to decrease the time required to perform vehicle frame alignments and lower the cost of aligning vehicle frames. It is also desirable to increase the accuracy and efficiency of vehicle frame alignments by providing securement components capable of attaching to vehicle frames in a wide variety of desired locations.

BRIEF SUMMARY OF THE INVENTION

There is, therefore, provided in the practice of the invention a plurality of novel securement components which are capable of attaching to a wide variety of vehicle frame members to increase vehicle frame alignment accuracy and efficiency. These components are portions of a system for anchoring frames and include spring shackle, rail vise, tie-down ratchet assembly, and hole adaptor securement components. Each component preferably includes a mounting mechanism, so that they can be slidably mounted on a cross beam.

The spring shackle securement component includes an L-shaped base plate and a clamp member adjustably coupled with the base plate for clamping the vehicle frame between the base plate and the clamp member. An attachment member is used to adjustably couple the base plate and the clamp member In a preferred embodiment, the spring shackle securement component also has a reinforcing frame to strengthen and reinforce the base plate, and the attachment member is threaded. Various clamp members are provided for versatility: a U bracket, a half cylinder, and a flat torsion bar. The half cylinder is preferably mounted on one side of the torsion bar which can be inverted.

The rail vise securement component has a rigid base plate with a guide channel and an actuator leg extending upwardly from the base plate. A back clamp leg is also attached to the base plate, and a movable clamp leg, which has a guide pin extending into the guide channel, is moved relative to the base by an actuator supported by the actuator leg.

In a preferred embodiment, the base plate has a second guide channel and the movable clamp leg has a second guide pin extending into the second guide channel. The actuator is preferably threaded, and a second actuator is also provided. A guide handle extends through the actuator leg and attaches to the movable clamp leg, so that an operator can easily move the movable clamp leg back and forth.

The hole adaptor securement component has a substantially cylindrical reference hole insert. The insert is configured and sized to fit with generally slip clearance into a vehicle frame reference hole.

In a preferred embodiment, the hole adapter includes a base plate to support the insert, and the insert is positioned at a location away from the center of the base plate. An adapter ring is provided with a central opening to receive the insert therein. The adapter ring is sized to fit with generally slip clearance in larger reference holes of vehicle frames.

The tie-down ratchet assembly securement component utilizes an elongated tie having a free end held by a tie attachment in a desired location. A ratchet mechanism operatively engages the tie to incrementally decrease a portion of the length of the tie between its free end and the ratchet mechanism.

In a preferred embodiment, the ratchet mechanism is mounted on a base plate, and the tie attachment utilizes a pin removably mounted on the base plate. The tie is a strap flexible over both its width and length for maximum versatility. The tie-down ratchet is preferably used in combination with the other securement components which can be provided with tie attachments to secure the free end of the tie in desired locations.

Accordingly, it is an object of the present invention to provide an improved system having improved securement components for anchoring frames to a platform to align the frames.

BRIEF DESCRIPTION OF THE DRAWINGS

These and other inventive features, advantages, and objects will appear from the following Detailed Description when considered in connection with the accompanying drawings in which similar reference characters denote similar elements throughout the several views and wherein.

DETAILED DESCRIPTION

Figure 1:
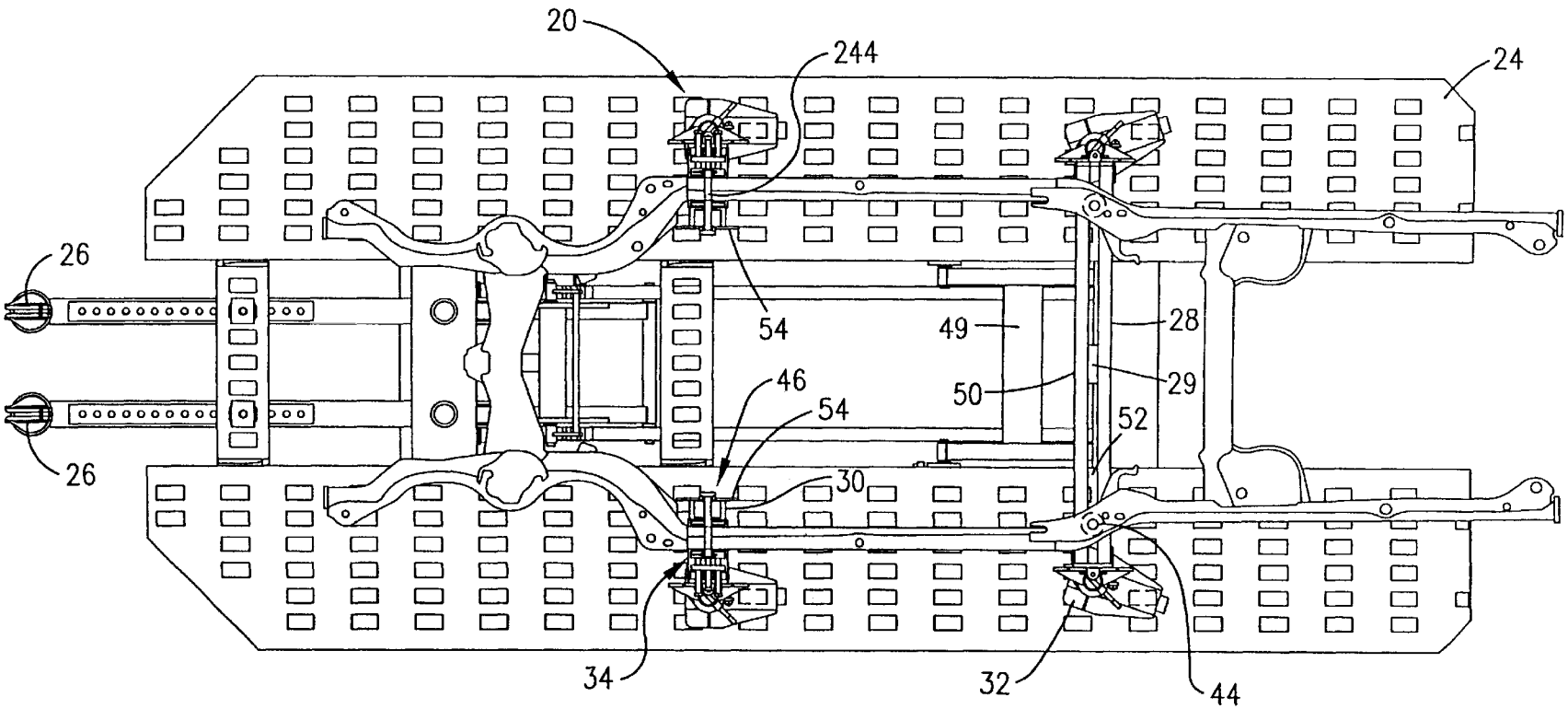
FIG. 1 is a top view of a system, according to the present invention, for anchoring frames to a platform whereby the frames are aligned by application of pulling forces.
Figure 2:
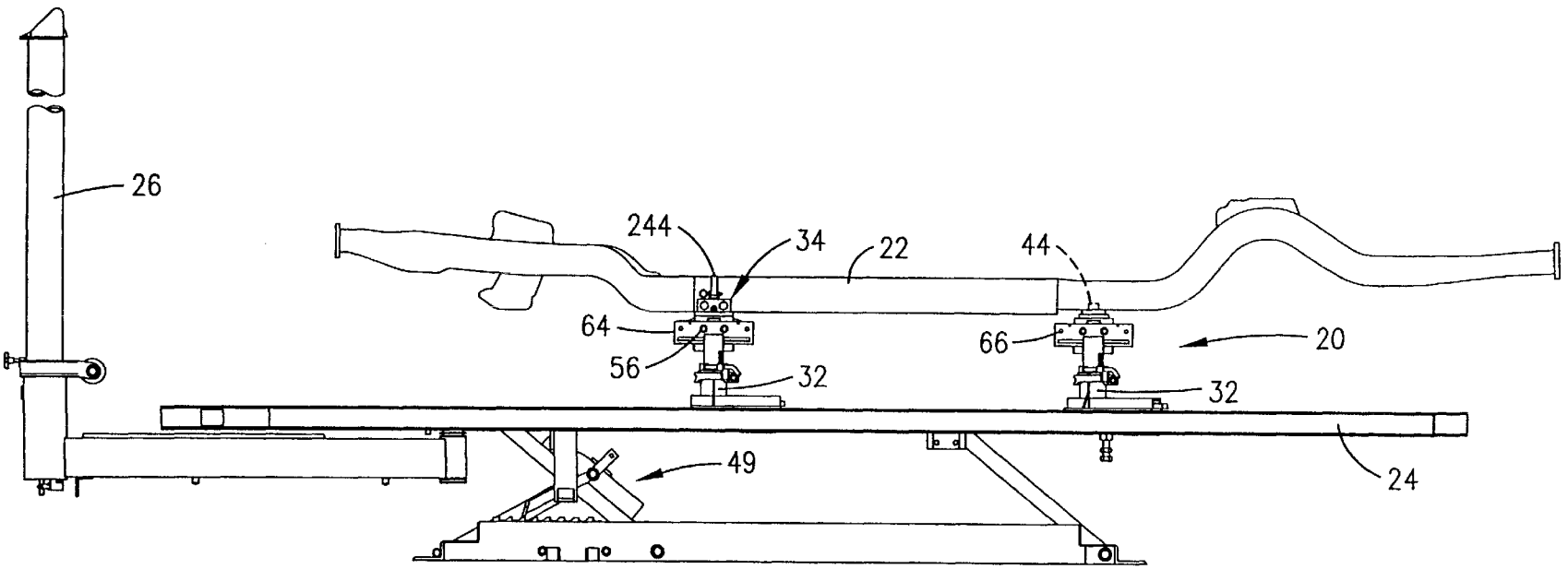
FIG. 2 is a side view of the system and the platform of FIG. 1.
Figure 26:
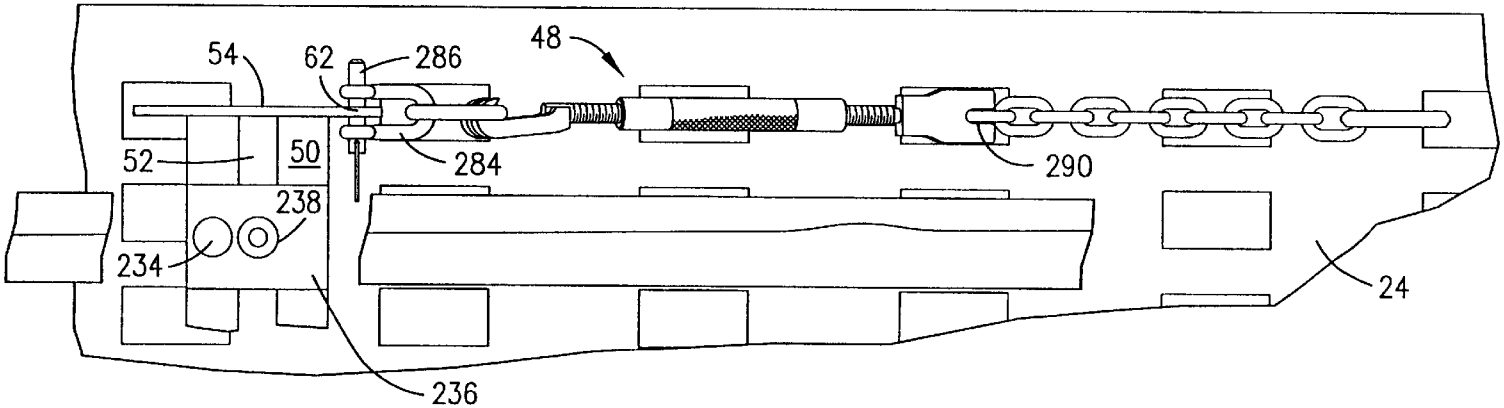
FIG. 26 is a fragmentary top view of a turnbuckle assist, according to the present invention.
Figure 27:
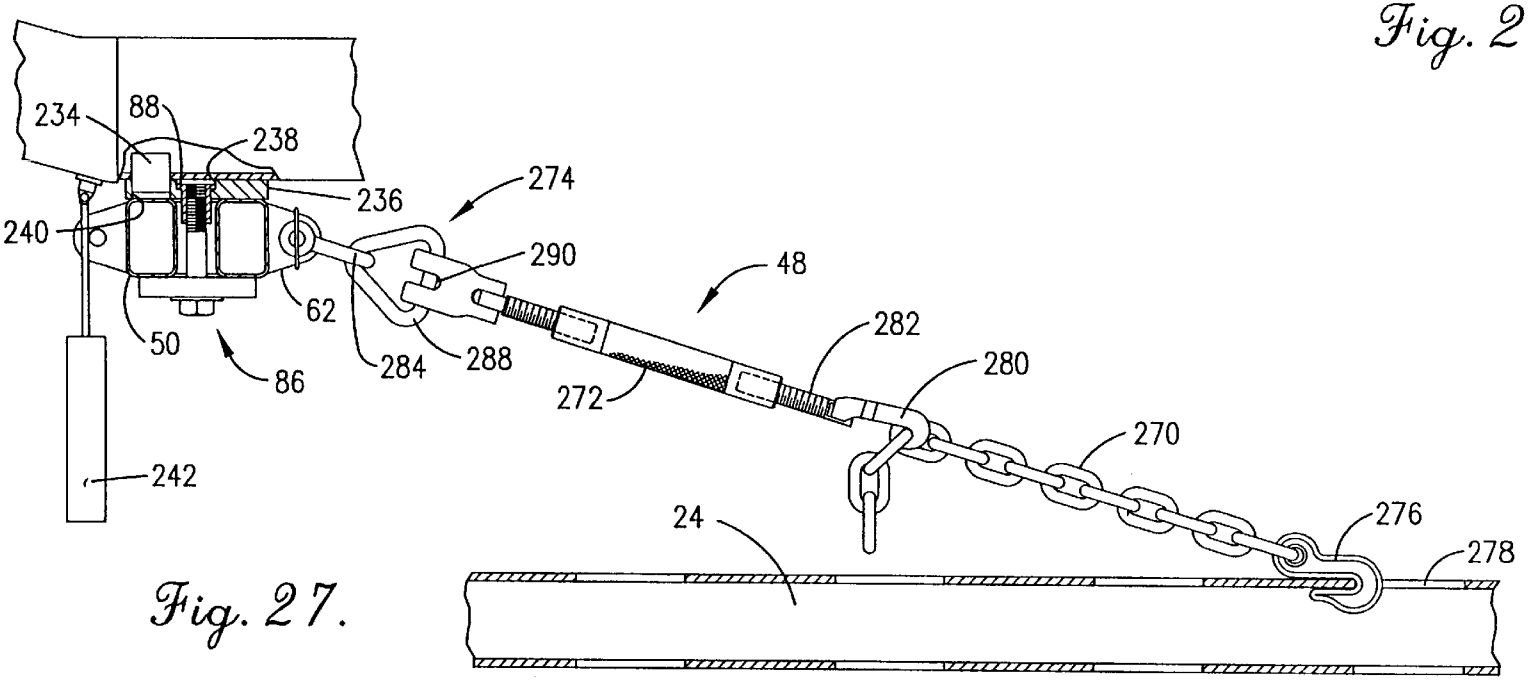
FIG. 27 is a side view in partial cross section of the turnbuckle assist of FIG. 25.

Referring to the drawings in greater detail, FIGS. 1 and 2 show a system 20 that anchors vehicle frames 22 to a platform 24 for alignment of the frames 22 by application of pulling forces generated by pulling towers 26. The system 20 includes a plurality of securement components operable to clamp onto the frames 22 in a variety of locations. The securement components are mounted on crossbeams 28,30 which are supported above the platform 24 by anchoring stands 32. The securement components include a rail vise 34 (FIGS. 3–7), C-channel clamp 36 (FIGS. 9 and 10), leaf spring shackle 38 (FIGS. 11–16), L-clamps 40, 41 (FIGS. 20–22), slide plate 42 (FIG. 22), hole adaptor 44 (FIGS. 23–25), tie-down ratchet assembly 46 (FIGS. 3, 5, and 25), and turnbuckle assist 48 (FIGS. 26 and 27). After the vehicle frame is positioned on the platform 24, the platform is raised by a lift mechanism 49, so that the vehicle frame is positioned at a convenient height for an operator to clamp the securement components onto the desired vehicle frame members.

Figure 3:
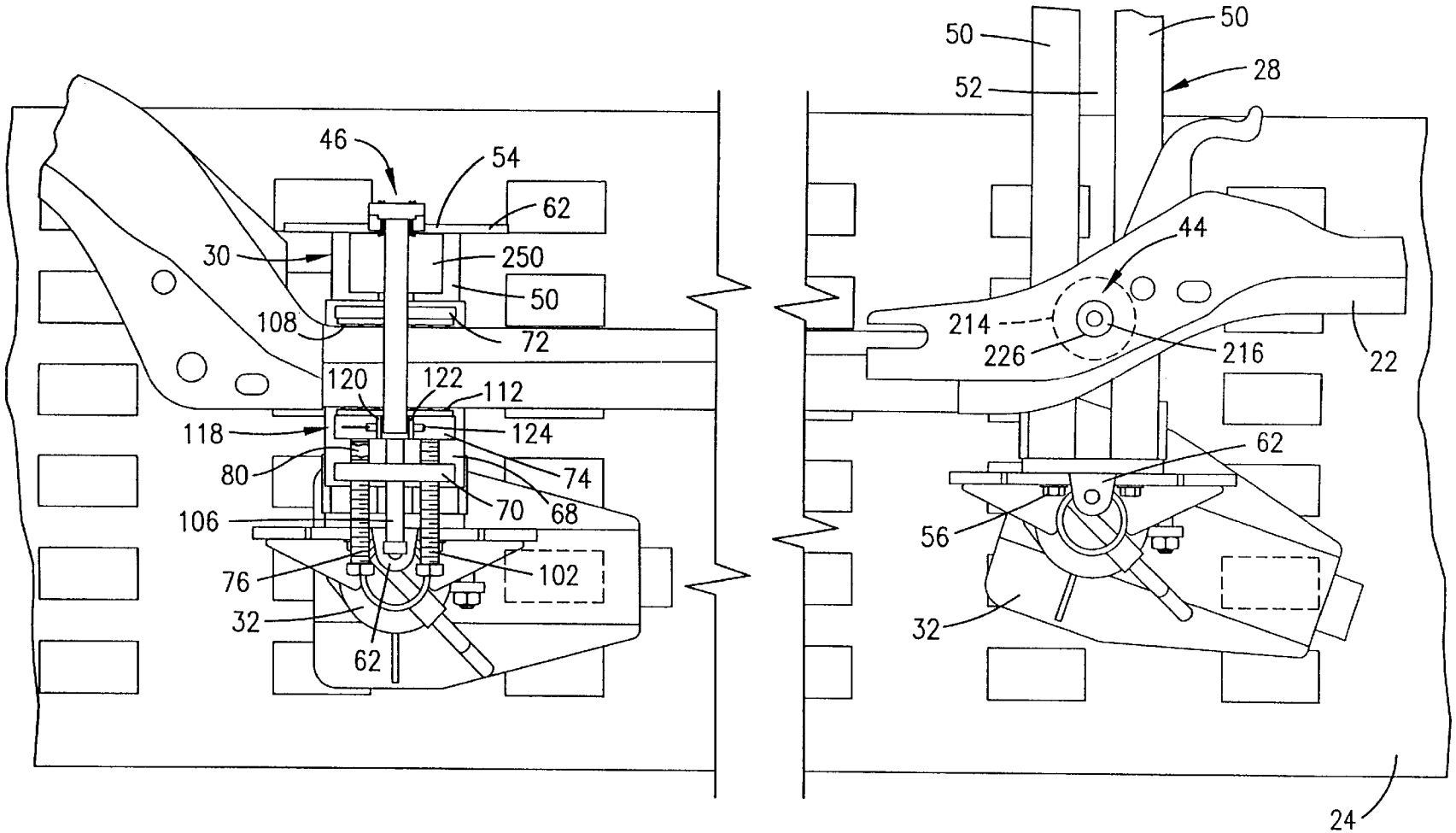
FIG. 3 is an enlarged and fragmentary top view of a rail vise securement component and a hole adapter securement component, according to the present invention.

Referring additionally to FIG. 3, the system 20 utilizes a plurality, preferably four, of the adjustable height anchoring stands 32 mounted on the platform 24. The operation of the anchoring stands and their features are more fully described in U.S. Pat. No. 4,344,314 to Aldrich et al., which is hereby fully incorporated herein by reference. The cross beams 28, 30 are mounted on the anchoring stands. The long cross beam 28 extends between two opposed anchoring stands and preferably has a length greater than the width of the vehicle frame 22. The short cross beam 30 cantilevers from the anchoring stand 32. Both types of cross beams are made up of parallel and substantially rectangular rails 50 which are spaced apart to define a mounting gap 52 therebetween. The mounting gap 52 has a desired gap width for mounting the securement components. The long cross beam 28 has a central support 29 to strengthen the cross beam. The short cross beam 30 utilizes an end plate 54 to secure the distal ends of the rails 50.

Figure 8:
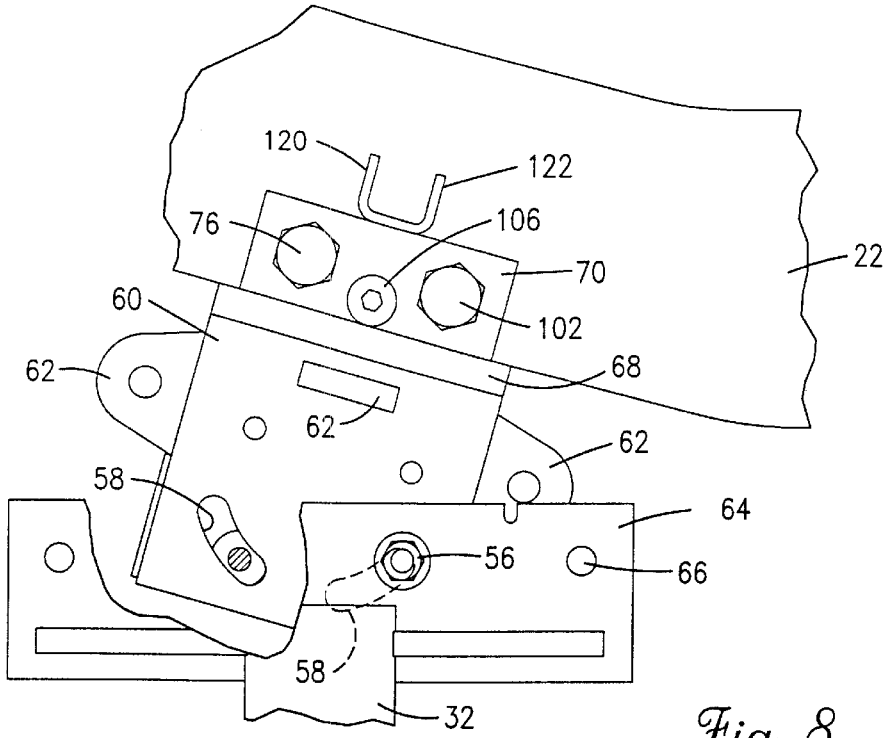
FIG. 8 is a fragmentary rear view illustrating the rotational capabilities of cross beams extending from anchoring stands to mount the securement components for attachment to frames.

Referring to FIG. 8, the cross beams 28, 30 (FIGS. 1 and 3) are mounted onto the anchoring stands 32 with fasteners 56, which extend through arcuate slots 58 in the base plates 60 of the cross beams. The arcuate slots 58 allow the cross beams and any securement components mounted thereon to rotate around a substantially horizontal axis. The cross beams also include several apertured tabs 62 for connection to the turnbuckle assist 48. The tabs 62 extend from the end plate 54 and the base plate 60. The top plate 64 of the anchoring stand 32 also includes apertures 66 for attachment of the turnbuckle assist 48.

Figure 5:
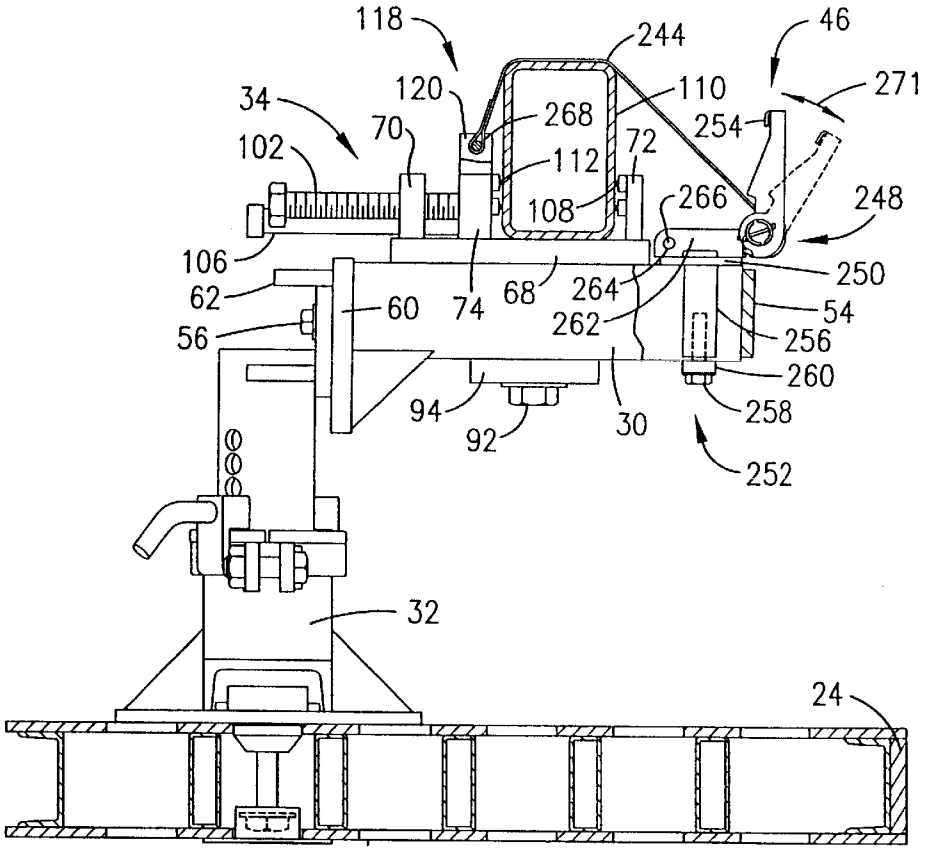
FIG. 5 is a fragmentary side view of the rail vise and anchoring stand of FIG. 3 in combination with a tie-down ratchet assembly according to the present invention.
Figure 6:
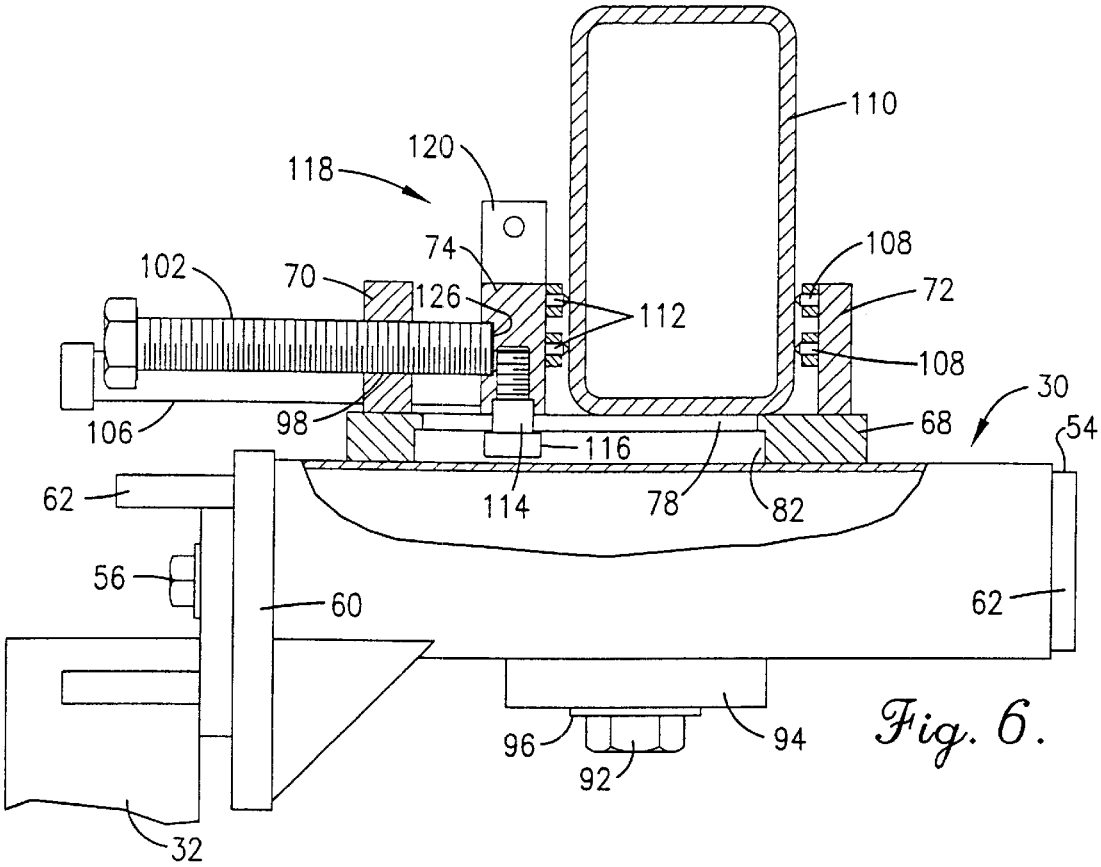
FIG. 6 is an enlarged vertical cross sectional view of the rail vise of FIG. 3.
Figure 7:
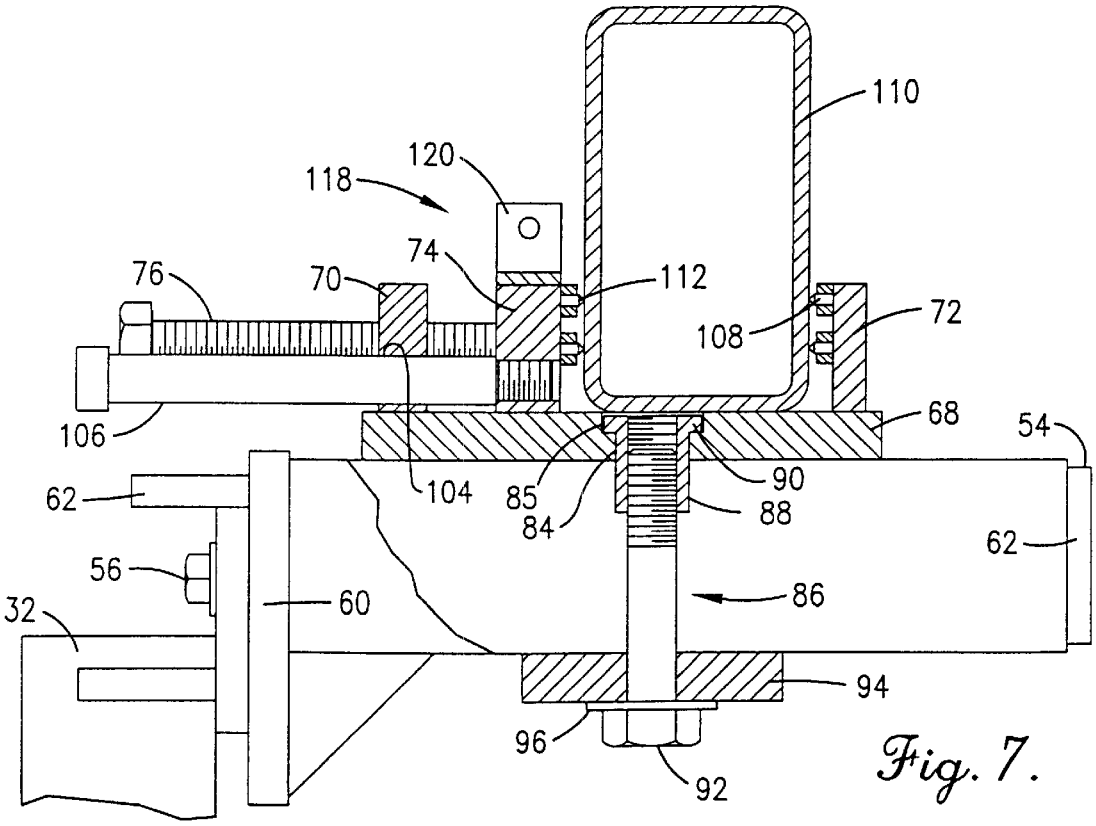
FIG. 7 is an enlarged vertical cross sectional view of the rail vise of FIG. 3 taken centrally through the rail vise.

Referring to FIGS. 5, 6, and 7, the rail vise 34 includes a base plate 68, an actuator leg 70, a back clamp leg 72, and a preferably movable front clamp leg 74. An actuator 76 is provided to move the front clamp leg 74 relative to the base plate 68 and clamp the vehicle frame between the clamp legs 72, 74.

The base plate 68 is substantially rigid and defines at least one guide channel 78. Preferably the base plate 68 defines a second guide channel 80 which is spaced apart from and substantially parallel to the first guide channel 78. The guide channels 78, 80 are spaced apart and each includes a lower enlarged recess 82. The base plate also defines a mounting aperture 84 with a counter bore 85, which is generally centrally located through the flat base plate 68. A mounting mechanism 86 is provided with a threaded collar 88 having an enlarged diameter portion 90 which mates with the counter bore 85 to hold the collar in the mounting aperture. A fastener 92, preferably a bolt, extends through a bottom mounting plate 94, between the rails 50 of the cross beam 30 and threads into the collar 88, which also extends between the rails 50 of the cross beam 30. A washer 96 is preferably interposed between the head of the fastener and the bottom mounting plate 94. Substantially identical mounting mechanisms 86 are utilized for the leaf spring shackle 38, the L-clamps 40, and the slide plate 42. The mounting mechanism 86 allows an operator to slide the securement component along the length of the cross beam and rotate the securement component relative to the cross beam around a substantially vertical axis until the mounting mechanism is tightened to fix the securement component.

The actuator leg 70 is substantially rigid and fixedly attached to the base plate at an end of the base plate and extends substantially perpendicularly up from the base plate 68. The actuator leg, which is generally rectangular, defines at least one actuator receptacle 98 which operatively receives the actuator 76 therein. Preferably the actuator leg defines a second actuator receptacle (not shown), which operatively receives a second actuator 102 therein. The actuator receptacle 98 preferably comprises threaded apertures. Thus, the actuators 76, 102 are preferably bolts threaded over their entire length and operatively engage the movable front clamp leg 74 at one end. The actuator leg 70 also defines a guide handle aperture 104 which slidably receives a guide handle 106. The guide handle 106 extends through the guide handle aperture 104 and attaches generally centrally to the movable clamp leg 74. The actuators 76, 102 are positioned on opposite sides of and vertically higher than the guide handle 106.

The back clamp 72 is substantially rigid and is preferably fixedly attached to the base plate 68 opposite the actuator leg 70. The back clamp 72 is generally rectangular and extends upwardly from the base plate substantially parallel to the actuator leg 70. The back clamp preferably includes a plurality of back teeth 108 operative to secure the rectangular vehicle frame member 110 and inhibit sliding of the frame member 110 relative to the rail vise 34.

The movable front clamp leg 74 includes front teeth 112, which functionally cooperate with the back teeth 108 to secure the vehicle frame member 110. The front clamp leg 74 is substantially rigid and has two guide pins 114 (only one shown), having enlarged heads 116 opposite the front clamp leg, to inhibit separation of the front clamp leg from the base plate. The guide pins extend downwardly from the front clamp leg 74 and extend into the guide channels 78, 80 defined in the base plate 68. The enlarged heads 116 of the guide pins are received in the recesses 82 of the guide channels, thereby securing the movable clamp leg to the base plate while permitting the movable clamp leg to slide relative to the base plate. Thus, the guide pins 114 are slidably received in the guide channels 78, 80 and operate to guide the front clamp leg as it moves relative to the base plate. The movable front clamp leg also includes a tie-down strap attachment 118, comprised of two opposed aperture arms 120, 122 extending upwardly from the top of the front clamp leg. The arms are preferably formed by an integral U-bracket. The apertures of the arms 120, 122 are aligned to receive a removable pin 124. The front clamp leg 74 is positioned between and substantially parallel to the actuator leg 70 and the back clamp leg 72. The front clamp leg defines two actuator recesses 126 facing the actuator leg. The actuator recesses 126 receive the actuators 76, 102 therein and permit the actuators to rotatably slide relative to the front clamp leg 74 so that the actuators can be threaded in and out of the actuator leg.

The actuators 76, 102 are threadably received in the actuator leg 70, so that rotation of the actuators moves the front clamp leg 74 between the actuator leg and the back clamp leg 72. To clamp the frame member 110, the actuators 76, 102 are rotated to push the movable clamp leg 74 towards the back clamp leg. To release the frame member 110, the actuators are rotated so that they retract from the frame member. The movable clamp leg 74 can then be pulled away from the frame member 110 by grasping the guide handle 106.

Figure 9:
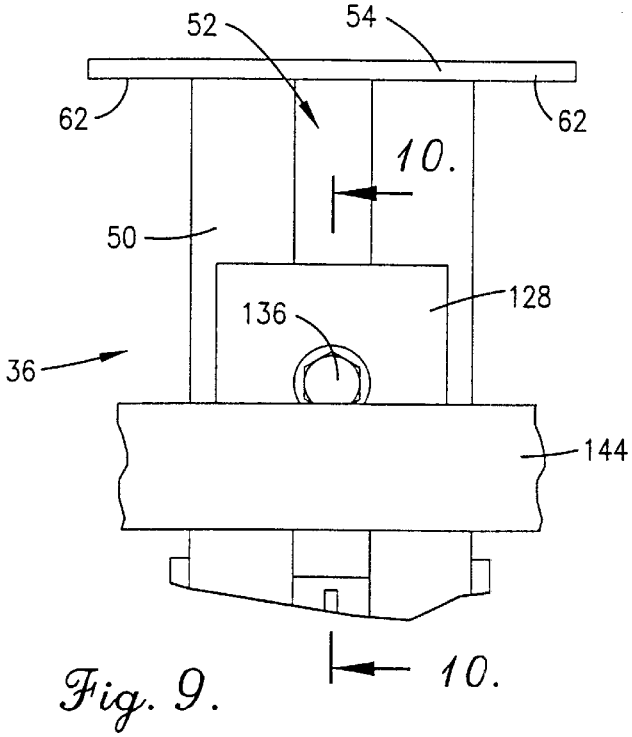
FIG. 9 is a fragmentary top view of a C-channel clamp securement component, according to the present invention.
Figure 10:
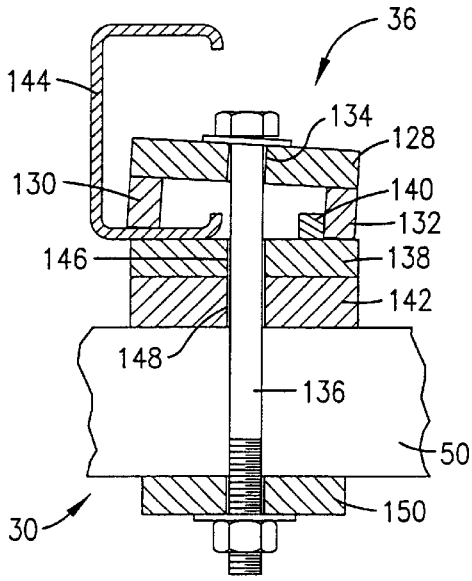
FIG. 10 is a vertical cross sectional view of the C-channel clamp taken along line 10—10 in FIG. 9.

Referring to FIGS. 9 and 10, the C-channel clamp 36 includes a C-plate 128 having parallel downwardly extending legs 130, 132 positioned on opposite edges of the C-plate 128. The C-plate defines a central mounting aperture 134, which receives a mounting fastener 136 therethrough. The C-channel clamp 36 also includes a base plate 138 having a positioning bar 140 extending parallel to the legs 130, 132 of the C-plate 128. The positioning bar 140 engages one of the legs of the C-plate to properly position the C-plate. A spacer plate 142 can also be positioned between the base plate 138 and the rails 50 of the cross beam 30 to adjust the height of the base plate.

One leg 130 of the C-clamp is positioned within a C-channel frame member 144 to clamp the C-channel frame member 144 between the leg 130 and the base plate 138. The other leg 132 of the C-plate 128 engages the base plate 138 and the positioning bar 140. The mounting fastener 136 is tightened to securely the clamp the C-channel frame member 144 therebetween. The base plate 138 also defines a mounting aperture 146, and the spacer plate 142 defines a mounting aperture 148. The mounting apertures 146, 148 slidably receive the mounting fastener 136. The mounting fastener 136 cooperates with a bottom apertured mounting plate 150 to form a mounting mechanism for the C-channel clamp.

Figure 11:
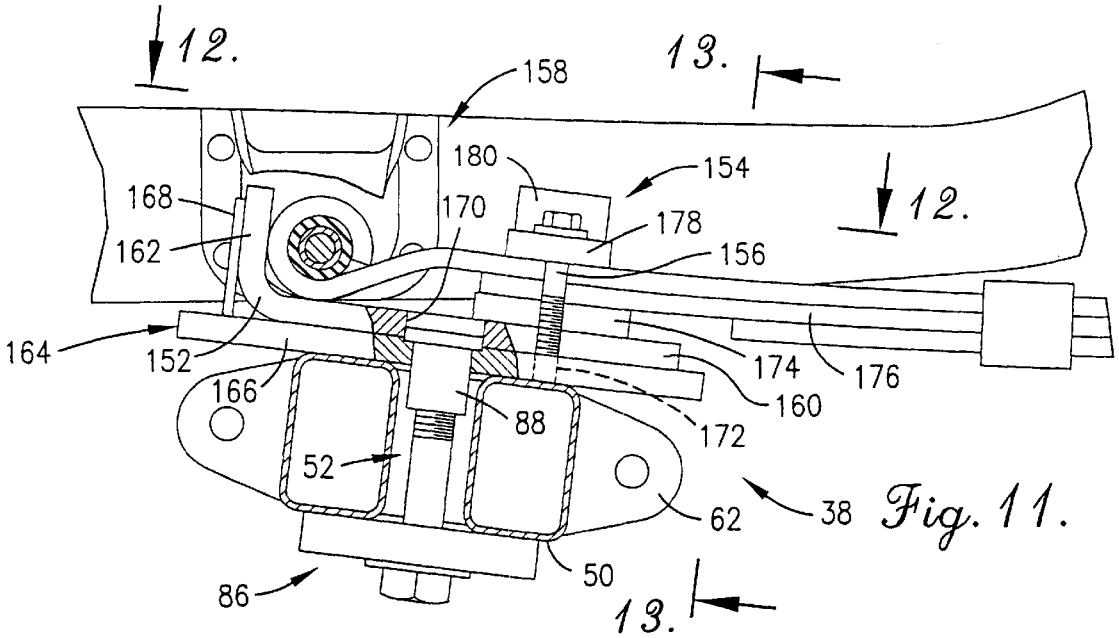
FIG. 11 is a fragmentary side view in partial cross section of a leaf spring shackle securement component, according to the present invention.
Figure 12:
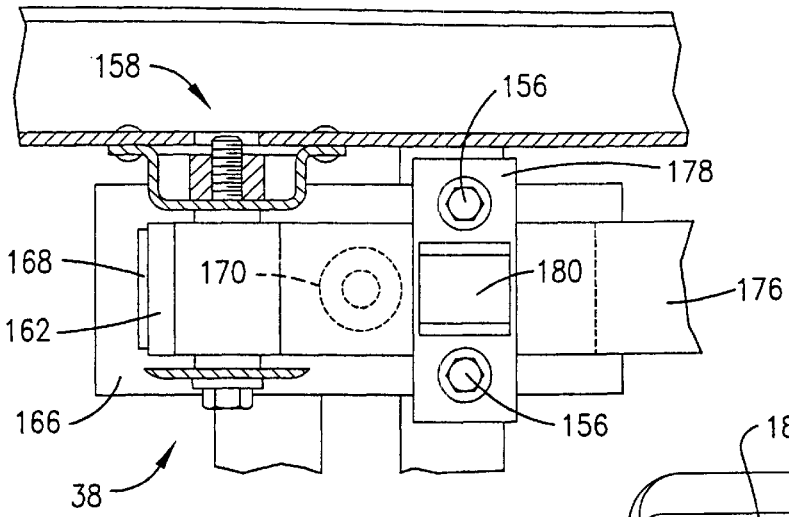
FIG. 12 is a fragmentary top view in partial cross section of the leaf spring shackle taken from the prospective of line 12—12 in FIG. 11.
Figure 13:
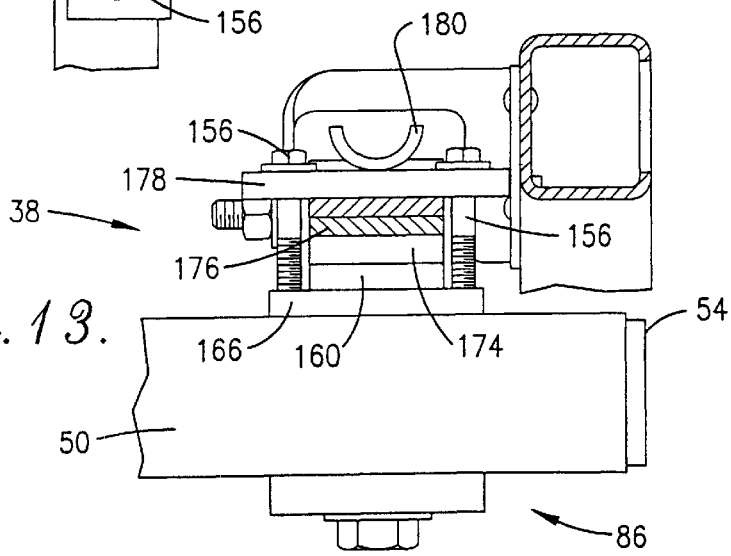
FIG. 13 is a fragmentary end view in partial cross section of the leaf spring shackle taken from the prospective of line 13—13 in FIG. 11.

Referring to FIGS. 11, 12, and 13, the leaf spring shackle 38 includes a rigid base plate 152, a clamp member 154, and an attachment member 156 adjustably coupling the base plate 152 and the clamp member 154. The base plate 152 cooperates with the clamp member 154 to clamp the vehicle frame 22 at its spring/suspension mounting bracket 158 which has an irregular configuration and is therefore difficult to clamp onto.

The base plate 152 is generally L-shaped and includes a base leg 160 and an upwardly extending leg 162 positioned at an end of the base leg. The base plate is preferably integrally formed by bending the upwardly extending leg 162 until it extends at an angle of approximately 90° to the longer base leg 160. The base plate is preferably strengthened by a reinforcing frame 164, including a bottom plate 166 adjacent and attached to the base leg 160 and an upright plate 168 adjacent and attached to the upwardly extending leg 162. The base leg 160 and the bottom plate 166 include generally central mounting apertures 170 to receive the mounting collar 88 of the mounting mechanism. The bottom plate 166 is preferably larger than the base leg 160 and defines attachment apertures 172 positioned on opposite sides of the base leg and generally opposite to the upwardly extending leg 162 and to the upright plate 168. If desired, a spacer plate 174 is positioned between the base leg 160 and the leaf spring 176 which attaches to the mounting bracket 158.

The clamp member 154 preferably comprises a flat torsion bar 178 having an arcuate clamp member 180, preferably a half-cylinder, fastened to one side. The clamp member 180 receives the attachment member 156 which preferably comprises a pair of fasteners extending through the torsion bar and threading into the attachment apertures 172, defined in the bottom plate 166. The torsion bar 178 is positioned on the top of the leaf spring 176, so that the leaf spring 176 is held between the torsion bar and the base leg 160. The leaf spring shackle 38 is positioned, so that the upwardly extending leg 162 engages the mounting bracket, thereby inhibiting lateral movement of the spring bracket 158 relative to the leaf spring shackle 38.

Figure 14:
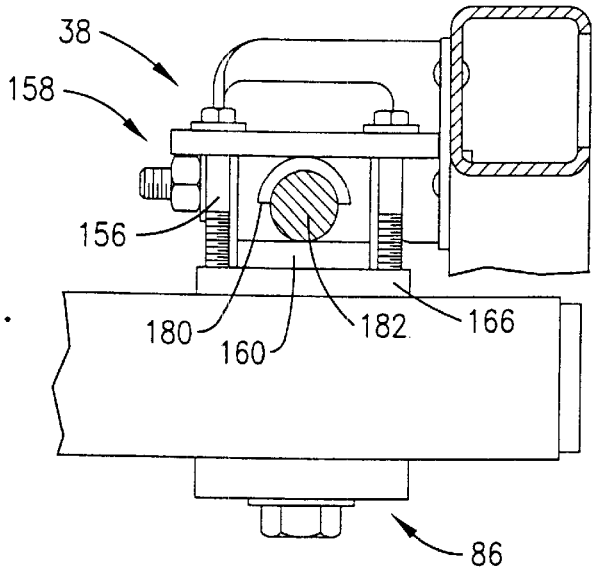
FIG. 14 is a fragmentary end view of the leaf spring shackle of FIG. 11, illustrating an alternate clamp member.
Figure 15:
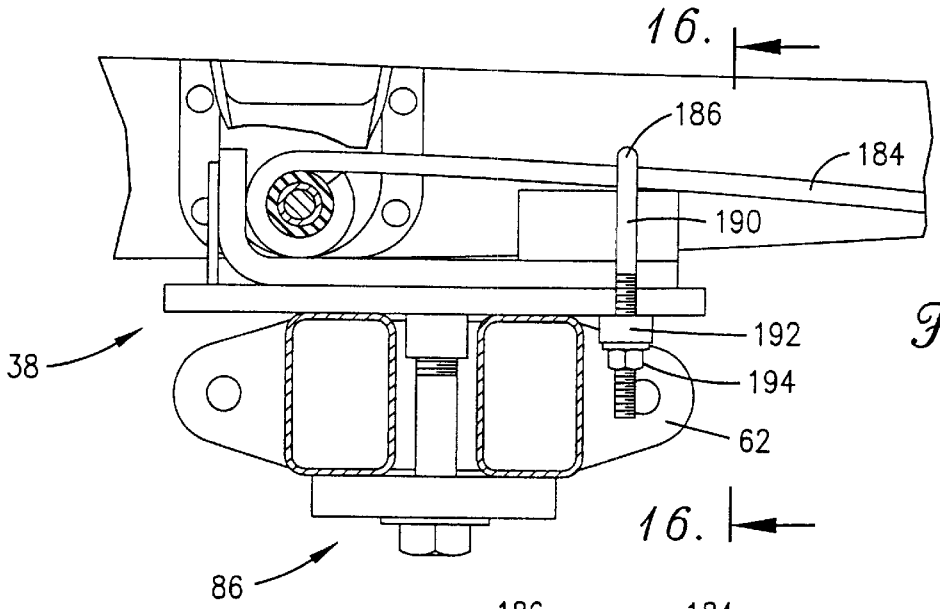
FIG. 15 is a fragmentary side view of the spring shackle of FIG. 11, illustrating a second alternate clamp member.
Figure 16:
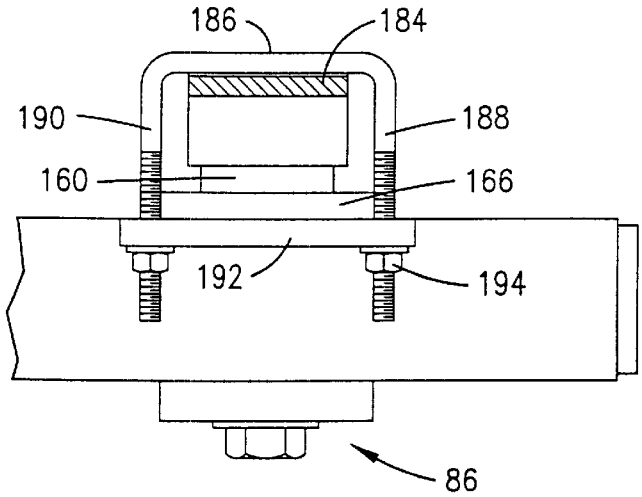
FIG. 16 is a fragmentary end view in partial cross section of the leaf spring shackle and the second alternate clamp member of FIG. 15.

Referring to FIG. 14, the torsion bar 178 is invertible, so that the arcuate clamp 180 can be extended downwardly to engage and clamp onto a cylindrical trail arm vehicle frame member 182. The arcuate clamp 180 is configured and sized to match the outer surface of the trail arm 182 and receive approximately half of the trail arm therein. Referring to FIGS. 15 and 16, if the vehicle has a wide leaf spring 184, such that the fasteners of the torsion bar cannot extend to either side of the leaf spring 184, a U-bracket attachment member 186 having the necessary spacing between its legs 188, 190 receives the leaf spring 184, the base leg 160, and the bottom plate 166 between its legs 188, 190. A clamp bar 192 receives the legs 188, 190 and is forced against the bottom plate 166 by nuts 194 which thread onto the legs of the U-bracket 186.

Figures 17, 18, 19:
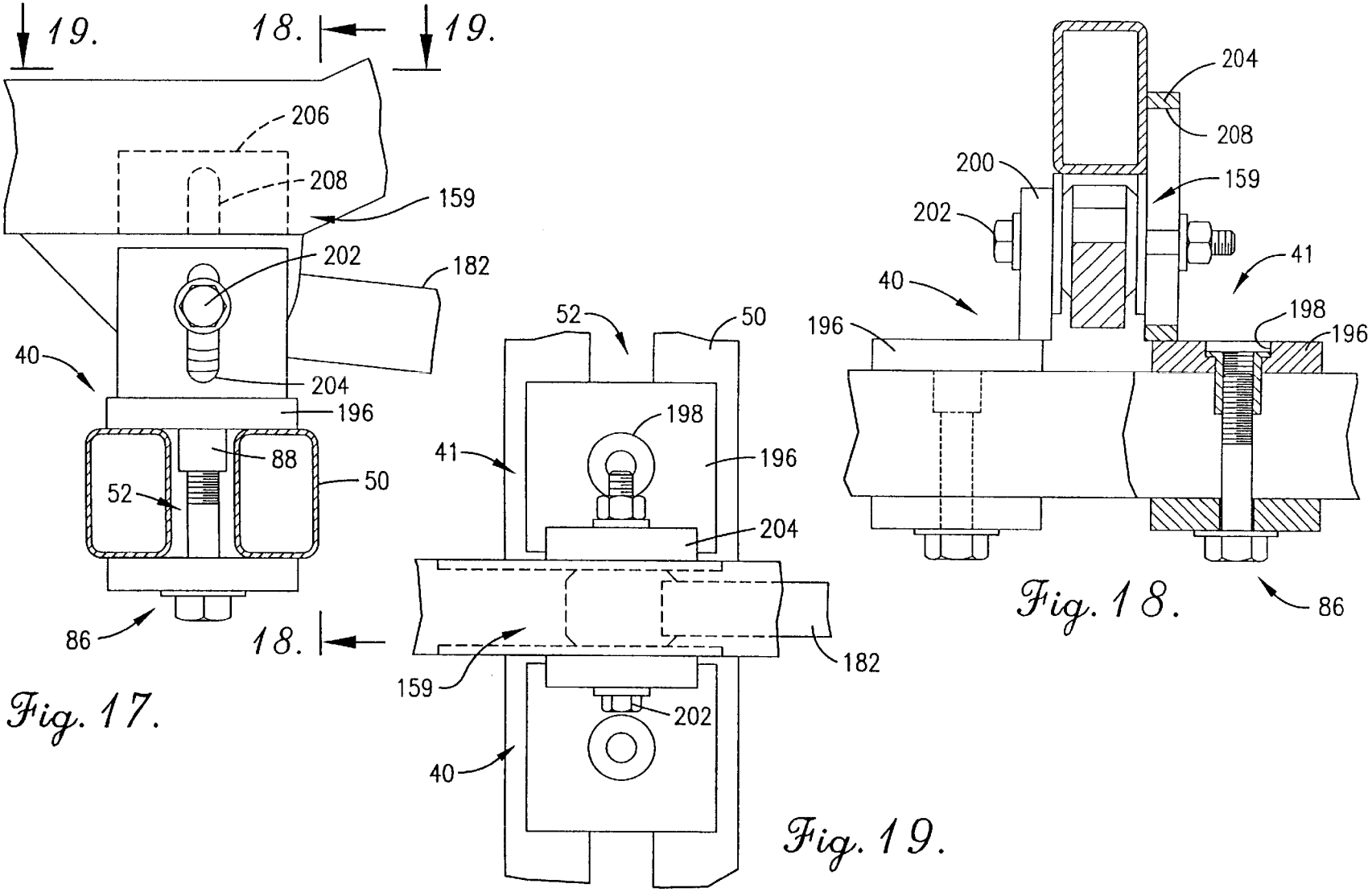
FIG. 17 is a fragmentary end view in partial cross section of two L-clamp securement components.
FIG. 18 is a fragmentary side view of the two L-clamps taken from the prospective of line 18—18 in FIG. 17.
FIG. 19 is a fragmentary top view of the two L-clamps taken from the prospective of line 19—19 in FIG. 17.

Referring to FIGS. 17, 18, and 19, if there is insufficient room for the leaf spring shackle 38, the fastener of the suspension mounting bracket 159 is removed and L-clamps 40, 41 are positioned on either side of the mounting bracket 159. The L-clamps 40, 41 include a base plate 196 having a countersunk mounting aperture 198 to receive the mounting collar 88 of the mounting mechanism 86. A short clamp plate 200 extends upwardly from the base plate 196 at substantially 90° to the base plate. The clamp plate 200 defines a slot 204 extending substantially vertically. The slot 204 receives a conventional fastener 202. The fastener 202 is positionable at various locations within the slot, as desired, to properly position the fastener 202 for connection to the vehicle frame. The clamp plate is provided in varying lengths. A taller clamp plate 206 defines a longer slot 208. The fastener extends through the slots 204,208 and the mounting bracket 159 to secure the mounting bracket from relative movement.

Figure 20:
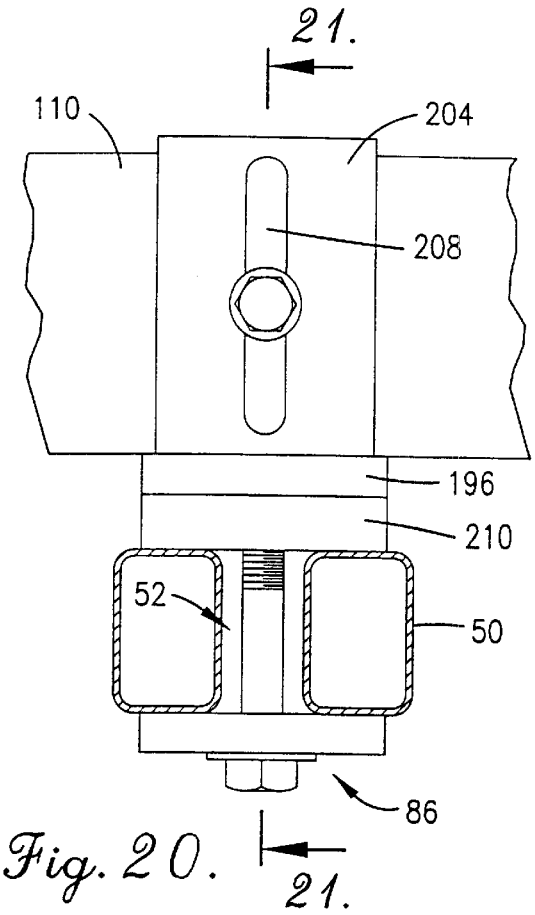
FIG. 20 is an end view in partial cross section of a single L-clamp securement component used to clamp onto a C-channel vehicle frame member.
Figure 21:
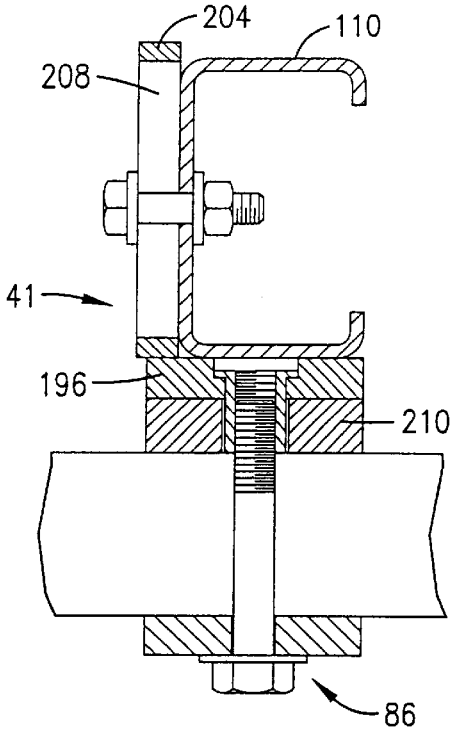
FIG. 21 is a fragmentary view in vertical cross section of the L-clamp taken along line 21—21 in FIG. 20.

Referring to FIGS. 20 and 21, the L-clamps 40, 41 can also be used to clamp various vehicle frame members, such as the C-channel 110. The L-clamp 41 can be used with spacer plates 210 to adjust the height of the L-clamp. The L-clamp 41 is attached to the C-channel 110 with a fastener, preferably a bolt 211 and nut 213. Washers 215 are also preferably used.

Figure 22:
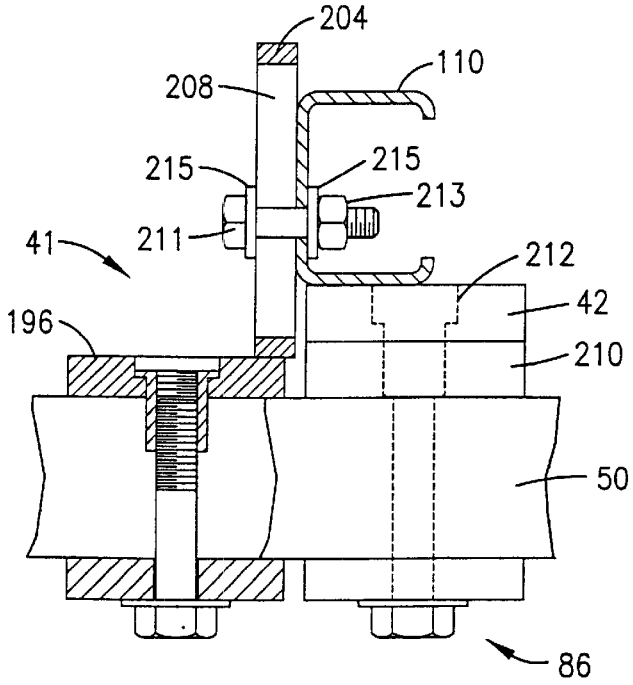
FIG. 22 is a side view in partial cross section of the L-clamp of FIG. 20 and a slide plate, according to the present invention.

Referring to FIG. 22, the slide plate 42 is a substantially rigid and generally flat plate having a mounting aperture 212 for engagement with the mounting mechanism 86. The slide plate 42 can be used with the spacer plate 210. The slide plate 42 is used to provide vertical support to the vehicle frame member being clamped, for example, with the L-clamp 41. The slide plate can also be used to inhibit downward vertical movement, while permitting the vehicle frame to slide over the top of the slide plate 42.

Figure 23:
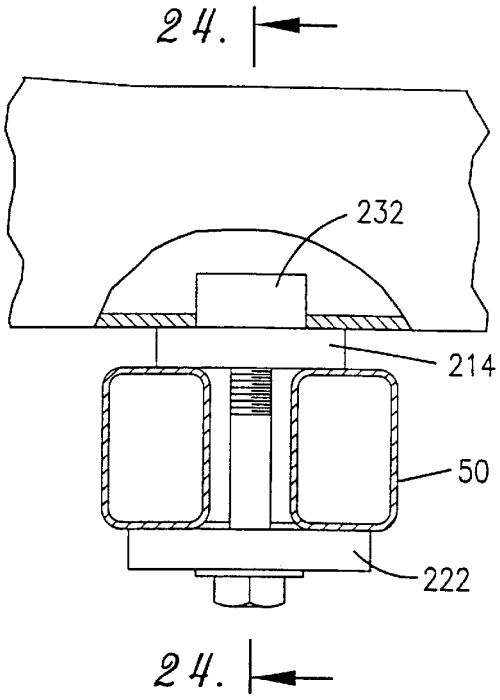
FIG. 23 is a fragmentary view in partial cross section of the hole adapter of FIG. 3.
Figure 24:
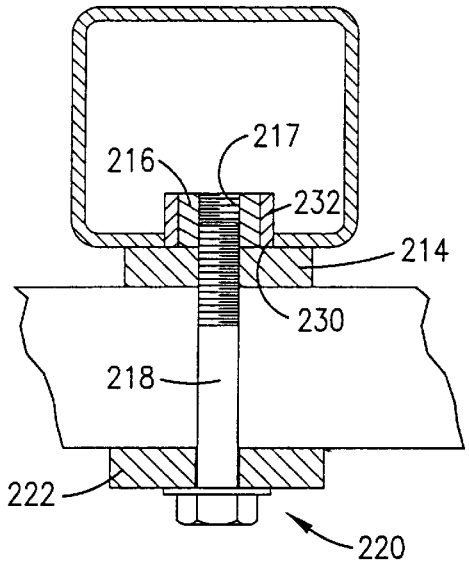
FIG. 24 is a vertical cross sectional view of the hole adapter taken along line 24—24 in FIG. 23.
Figure 25:
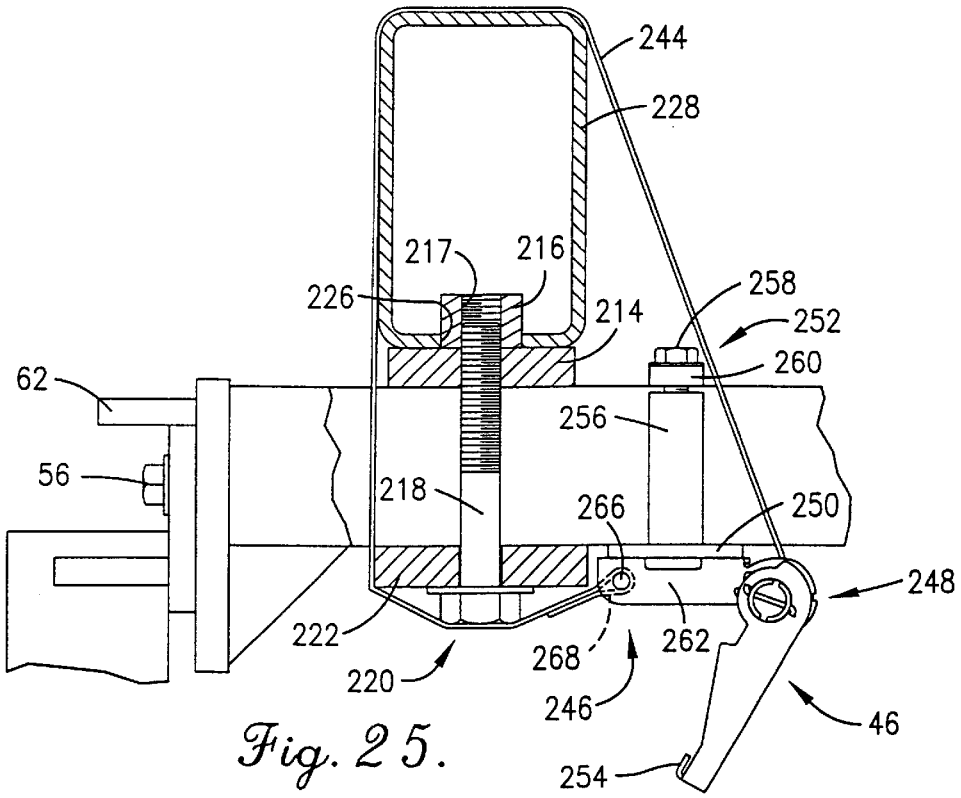
FIG. 25 is a vertical cross sectional view of the hole adapter of FIG. 3 in combination with the tie-down ratchet assembly of FIG. 5.

Referring to FIGS. 23,24, and 25, the hole adapter 44 preferably includes a base plate 214 and a substantially cylindrical reference hole insert 216. The insert 216 is fixedly attached to the base plate 214 and defines a central threaded aperture 217 for threadably receiving a fastener of the mounting mechanism 220, which also includes a bottom mounting plate 222. The insert is centrally positioned on the cylindrical base plate. The base plate includes a mounting aperture 224 aligned with the central threaded aperture 217 of the insert 216. The insert is configured and sized to fit with slip clearance into a reference hole 226 defined in a vehicle frame member 228. The slip clearance allows the insert to be introduced into the reference hole 226 with little or no force but does not permit the insert 216 to move laterally within the reference hole 226. For larger reference holes 230 an adapter ring 232 is positioned over the insert 216. The insert is introduced into the central opening of the cylindrical adapter ring and has a slip clearance therein. The adapter ring is configured and sized to fit with slip clearance in a large reference hole 230 of a vehicle frame member.

Alternatively, as illustrated in FIGS. 26 and 27, an insert 234 is spaced apart from the center of a rectangular base plate 236, and the base plate defines a mounting aperture 238 to receive the collar 88 of the mounting mechanism 86. The insert 234 is welded into an opening 240 in the base plate 236. The offset insert 234 is also configured and sized to fit into the reference opening with slip clearance. The insert 234 is offset from the center, so that the cross beam can be positioned where it does not interfere with a hanging reflector 242 used as described in the Danielson patents listed above.

Figure 4:
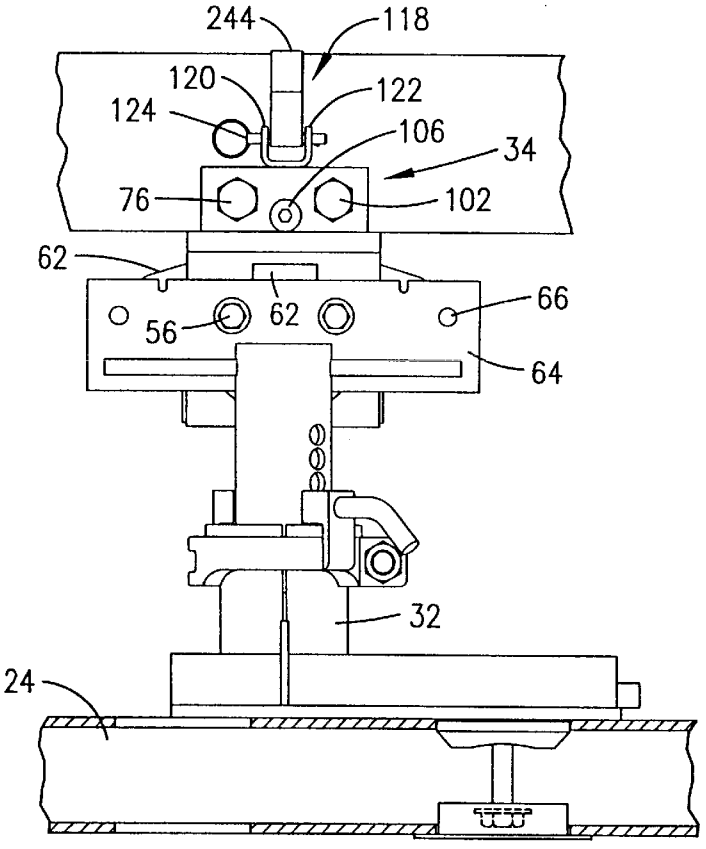
FIG. 4 is a fragmentary rear view in partial cross section of the rail vise of FIG. 3.

Referring to FIGS. 4,5, and 25, the tie-down ratchet assembly 46 includes a tie 244, a tie attachment 246, and a ratchet mechanism 248. The ratchet mechanism 248 is mounted on a base plate 250, which is secured to the cross beam 30 by a mounting mechanism 252. The preferred ratchet mechanism is available from ANCRA and can be obtained by requesting part number 43320. A handle 254 is operatively coupled with the ratchet mechanism 248 to incrementally tension the tie 244. The mounting mechanism 252 includes a threaded collar 256 attached to the base plate and sized to fit in the gap 52 between the rails 50. A fastener 258 extends through a clamp bar 260 and threads into the treaded collar 256, thereby securing the tie-down strap assembly 46 to the cross beam.

The ratchet mechanism 248 is mounted between two upright walls 262 fixedly attached to the base plate 250. The tie attachment 246 comprises a pair of apertures 264 in the upright walls 262 and a cylindrical pin 266 removably inserted in the apertures 264. The tie 244 preferably comprises a strap having a width, length, and a free end. The strap is flexible over both its length and width, and the free end includes a loop 268 which receives the pin therethrough to secure the free end loop 268 to the tie attachment 246. The base plate 250 can be positioned above or below the cross beam as desired, to secure the vehicle frame member from moving vertically relative to the cross beam when used in combination with the hole adaptor 44 or the rail vise 34, for example. The tie 244 preferably passes through the rail gap 52. As illustrated specifically in FIG. 5, the free end loop 268 receives the pin 124 of the strap attachment 118 that is connected to the movable front clamp arm 74 of the rail vise 34 to secure the free end loop in a desired location. The width of the tie 244 is approximately equal to the width of the gap 52 between the rails 50. By operating the handle as illustrated by arrow 271 in FIG. 5, the ratchet mechanism operatively engages the tie to incrementally decrease a portion of the length of the tie between the free end loop and ratchet mechanism.

Referring again to FIGS. 26 and 27, the turnbuckle assist 48 includes an extension chain 270, a threaded actuating member 272, and an attachment assembly 274 operative to attach the turnbuckle to a desired one of the tabs 62 or the top plate 64 of the anchoring stand 32. The extension chain terminates in a hook 276 which hooks into an opening 278 in the platform 24. The actuating member 272 includes a knurled outer surface and is threaded at opposite ends to threadably receive hooks 280 having threaded shafts 282. The attachment assembly 274 includes a U-collar 284 and a pin 286 extending through openings in the U-collar and one of the apertured tabs 62. A triangular bracket 288 is hooked onto by one of the hooks 280. The hooks 280 preferably comprise split hooks which receive lengths of the chain 270 in central slots 290. By rotation of the actuating member 272 the turnbuckle can be tensioned to further secure the cross beam or anchoring stand and further inhibit movement which would otherwise be caused by the pulling forces exerted by the towers 26.

In operation, a vehicle is driven on to the platform 24, and the platform 24 is then raised by the lift mechanism 49. The anchoring stands 32 are positioned on the platform 24 and the hanging reflectors 242 are put in position. The desired securement components are mounted on the cross beams with the mounting mechanisms 86 and slid into the desired positions. After the securement components are positioned as desired, the mounting mechanisms are tightened to inhibit relative movement of the securement components. The securement components are attached to the vehicle frame members as described above to fix those locations from movement against the pulling force exerted by the towers 26.

The system 20 for anchoring frames 22 to a platform 24 according to the present invention provides a variety of securement components operable to fix a vehicle frame in an increased variety of locations. Thus, an operator is able to fix the vehicle frame where desired to properly realign the vehicle frame with a force exerted by the towers 26. Further, the securement components are more easily attached to and removed from the vehicle frame members, so that less time is required to secure the vehicle frame 22 for alignment.

Thus, a system for anchoring frames to a platform is disclosed which utilizes a plurality of versatile securement components to fix a vehicle frame in almost any desired location, thereby more quickly aligning vehicle frames with increased accuracy. While preferred embodiments and particular applications of this invention have been shown and described, it is apparent to those skilled in the art that many other modifications and applications of this invention are possible without departing from the inventive concepts herein. It is, therefore, to be understood that, within the scope of the appended claims, this invention may be practiced otherwise than as specifically described, and the invention is not to be restricted except in the spirit of the appended claims. Though some of the features of the invention may be claimed in dependency, each feature has merit if used independently.

What is claimed is:

1. A spring shackle securement component for attachment to a vehicle frame, the securement component comprising:

a generally L-shaped and substantially rigid base plate having a base leg and an upwardly extending leg;

a clamp member adjustably coupled with the base plate for clamping the spring of the vehicle frame between the base leg of the base plate and the clamp member; and an attachment member adjustably coupling the base plate and the clamp member.

2. The securement component according to claim 1 wherein the upwardly extending leg comprises an end leg positioned at an end of the base leg, the end leg extending at an angle of approximately 90° to the base leg.

3. The securement component according to claim 1 further comprising a reinforcing frame including a bottom plate attached to the base leg and an upright plate attached to the upwardly extending leg.

4. The securement component according to claim 3 wherein the attachment member comprises a threaded attachment member threadably received in the bottom plate.

5. The securement component according to claim 1 wherein the clamp member comprises a U-bracket having legs receiving the base plate therebetween.

6. The securement component according to claim 1 wherein the clamp member comprises an arcuate clamp member for clamping onto a trail arm vehicle frame member.

7. The securement component according to claim 1 further comprising a spacer plate positionable between the base leg and the vehicle frame member.

8. The securement component according to claim 1 further comprising a mounting mechanism for slidably mounting the securement component on a cross beam.

9. A spring shackle securement component for attachment to a vehicle frame, the securement component comprising:

a generally L-shaped and substantially rigid base plate having a base plate having a base leg and an upwardly extending leg;

a clamp member adjustably coupled with the base plate for clamping the vehicle frame between the base plate and the clamp member, wherein the clamp member comprises an arcuate clamp member for clamping onto a trail arm vehicle frame member and wherein the arcuate clamp member comprises approximately a half cylinder mounted on an invertible, substantially flat torsion bar; and an attachment member adjustably coupling the base plate and the clamp member.

10. A spring shackle securement component for attachment to a vehicle frame, the securement component comprising:

a generally L-shaped and substantially rigid base plate having a base leg and an upwardly extending leg;

a clamp member adjustably coupled with the base plate for clamping the vehicle frame between the base plate and the clamp member; and an attachment member adjustably coupling the base plate and the clamp member and permitting shifting of the clamp member toward and away from the base leg of the base plate.

11. The securement component according to claim 10 wherein the upwardly extending leg comprises an end leg positioned at an end of the base leg, the end leg extending at an angle of approximately 90° to the base leg.

12. The securement component according to claim 10 further comprising a reinforcing frame including a bottom plate attached to the base leg and an upright plate attached to the upwardly extending leg.

13. The securement component according to claim 12 wherein the attachment member comprises a threaded attachment member threadably received in the bottom plate.

14. The securement component according to claim 10 wherein the clamp member comprises a U-bracket having legs receiving the base plate therebetween.

15. The securement component according to claim 10 wherein the clamp member comprises an arcuate clamp member for clamping onto a trail arm vehicle frame member.

16. The securement component according to claim 10 further comprising a spacer plate positionable between the base leg and the vehicle frame member.

17. The securement component according to claim 10 further comprising a mounting mechanism for slidably mounting the securement component on a cross beam.

* * * * *